US005918971A

United States Patent [19]

Yu

[11] Patent Number: 5,918,971

[45] Date of Patent: Jul. 6, 1999

[54] LAMP DEVICE

[76] Inventor: Jack Yu, No. 109-1, Avenue 6, Lane 164, Tzong Sa Road, Da Du Hsiang Taichung Hsien, Taiwan

[21] Appl. No.: 08/856,368

[22] Filed: May 14, 1997

[51] Int. Cl.[6] ..... F21V 17/00

[52] U.S. Cl. ..... 362/448; 362/356; 362/440

[58] Field of Search ..... 362/351, 352, 362/353, 355, 356, 361, 410, 440, 443, 444, 450, 448

[56] References Cited

U.S. PATENT DOCUMENTS 34,805 3/1862 Matthews ..... 362/443

1,117,270 11/1914 Sofio et al. ..... 362/410

1,453,099 4/1923 Euphrat ..... 362/440

*Primary Examiner*—Y. Quach

[57] ABSTRACT

A lamp device includes a socket secured in a housing for securing a light bulb. A lamp shade includes an upper portion secured in the housing. A spring member includes a spring leg for biasing against the upper portion of the lamp shade and for securing the lamp shade to the housing. The lamp shade is preferably made of paper material for allowing the lamp shade to have a light weight and for allowing the lamp shade to be easily secured to the housing by the spring member.

1 Claim, 4 Drawing Sheets

LAMP DEVICE

BACKGROUND OF THE INVENTION

1. Field of the Invention

The present invention relates to a lamp, and more particularly to a lamp device.

2. Description of the Prior Art

Typical lamps comprise a lamp housing and a lamp shade secured to the housing by fasteners. The typical lamp shade is typically made of acrylic material or glass material and will be easily broken when the fasteners are over threaded toward the lamp shade. In addition, the typical lamp shade is heavy and should be secured in place by fasteners.

The present invention has arisen to mitigate and/or obviate the afore-described disadvantages of the conventional lamps.

SUMMARY OF THE INVENTION

The primary objective of the present invention is to provide a lamp device which includes a lamp shade that may be easily secured to the lamp housing without fasteners such as screws.

In accordance with one aspect of the invention, there is provided a lamp device comprising a housing, a socket secured in the housing for securing a light bulb, a lamp shade including an upper portion secured in the housing, and means for biasing against the upper portion of the lamp shade and for securing the lamp shade to the housing. The lamp shade is preferably made of paper material for allowing the lamp shade to have a light weight and for allowing the lamp shade to be easily secured to the housing by the spring biasing member.

The housing includes a hole, the socket includes a bolt extended through the hole of the housing, the biasing means includes a plate having an opening for engaging with the bolt and having a spring leg for biasing against the upper portion of the lamp shade.

The plate includes at least one groove, the biasing means includes a spring member having at least one extension secured in the at least one groove and having the spring leg for biasing against the upper portion of the lamp shade.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
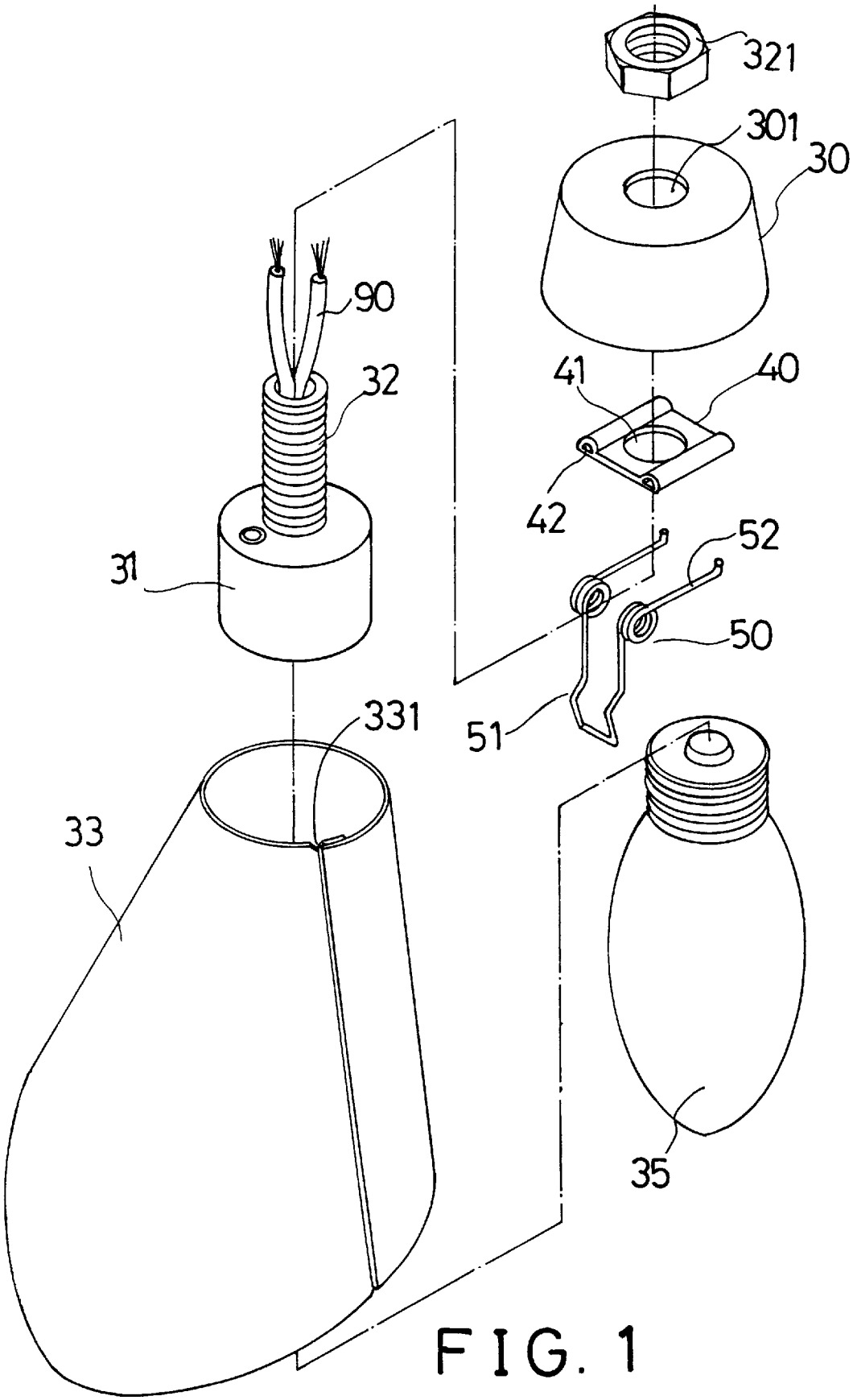
FIG. 1 is an exploded view of a lamp device in accordance with the present invention.
Figure 2:
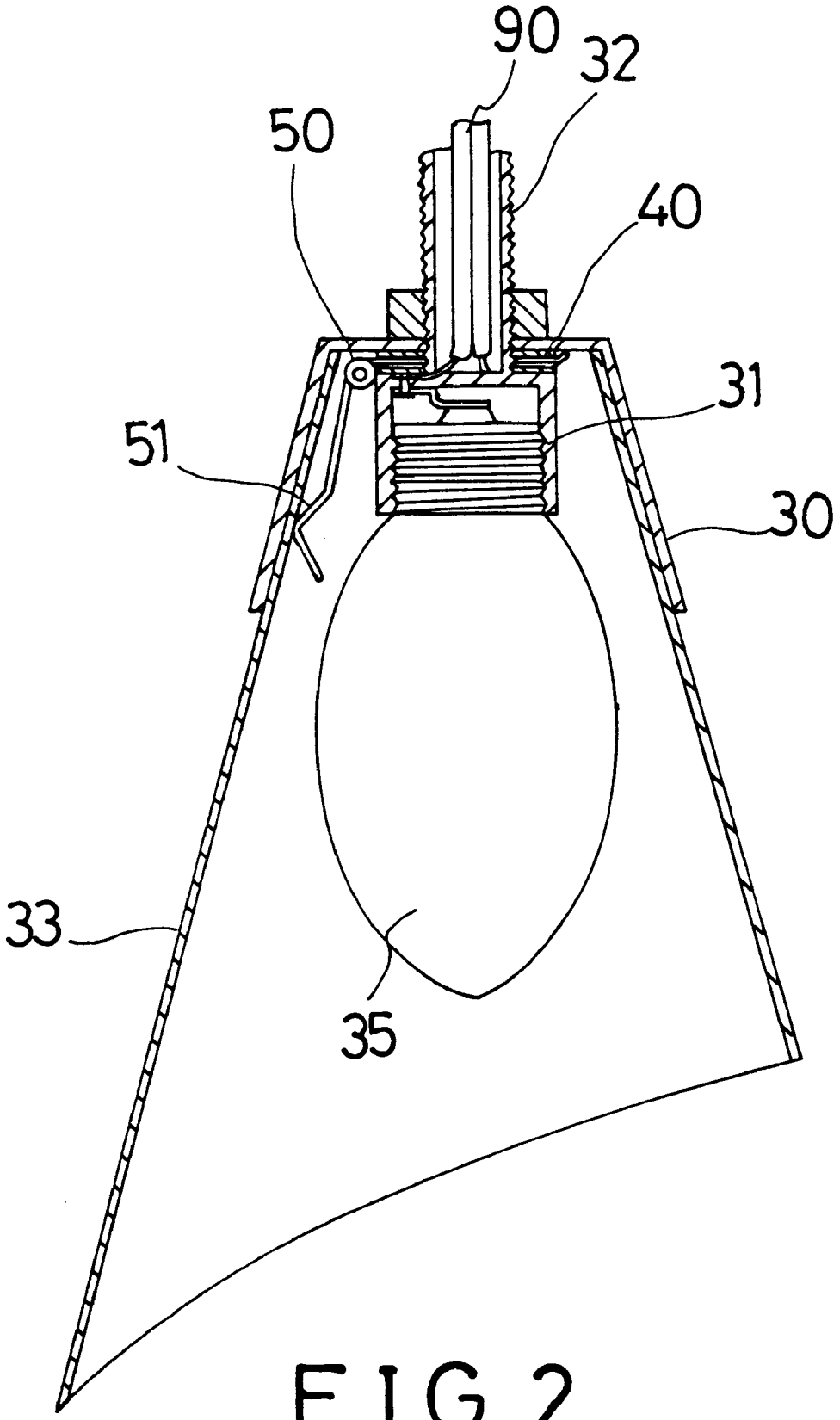
FIG. 2 is a cross sectional view of the lamp device.
Figure 3:
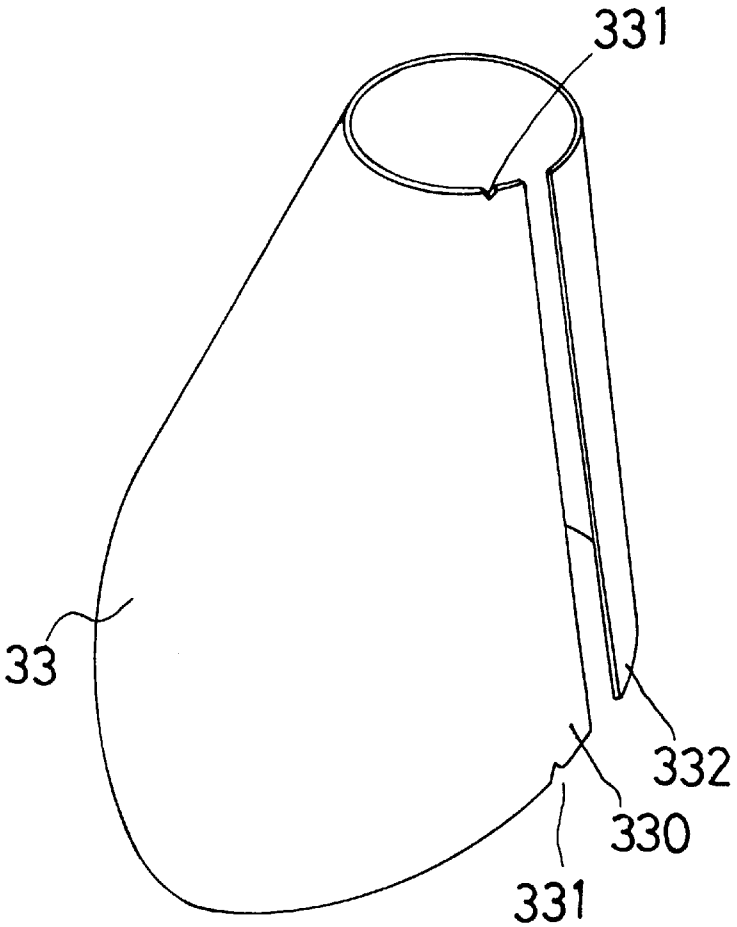
FIG. 3 is a perspective view of a lamp shade.

Referring to the drawings, and initially to FIGS. 1 to 3, a lamp device in accordance with the present invention comprises a housing 30 including a hole 301. A socket 31 for securing a light bulb 35 includes a bolt 32 extended upward for engaging through the hole 301 of the housing 30 and for engaging with a nut 321 so as to secure the socket 31 in the housing 30. Electric wires 90 may engage through the bolt 32. A lamp shade 33 is preferably made of paper material to which beautiful patterns may be easily applied. The lamp shade 33 (FIG. 3) includes two notches 331 formed in the upper and the lower portion of one side 330 of a paper panel for allowing the other side 332 of the paper panel to be easily aligned and secured to the side 330 by adhesive material. The lamp shade 33 includes an upper portion that may be engaged into the housing 30.

A plate 40 includes an opening 41 for engaging with the bolt 32 and for allowing the plate 40 to be secured between the housing 30 and the socket 31. The plate 40 includes two grooves 42 for engaging with two extensions 52 of a spring member 50. The spring member 50 includes a spring leg 51 for engaging with the upper portion of the lamp shade 33 (FIG. 2) and for securing the lamp shade 33 to the housing 30. It is to be noted that the lamp shade 33 is preferably made of paper material such that the lamp shade 33 includes a light weight and such that the lamp shade 33 may be easily secured to the housing 30 by the spring leg 51 of the spring member 50. The lamp shade 33 may thus be easily and quickly secured to the housing 30 and may be easily disengaged from the housing 30.

Figure 5:
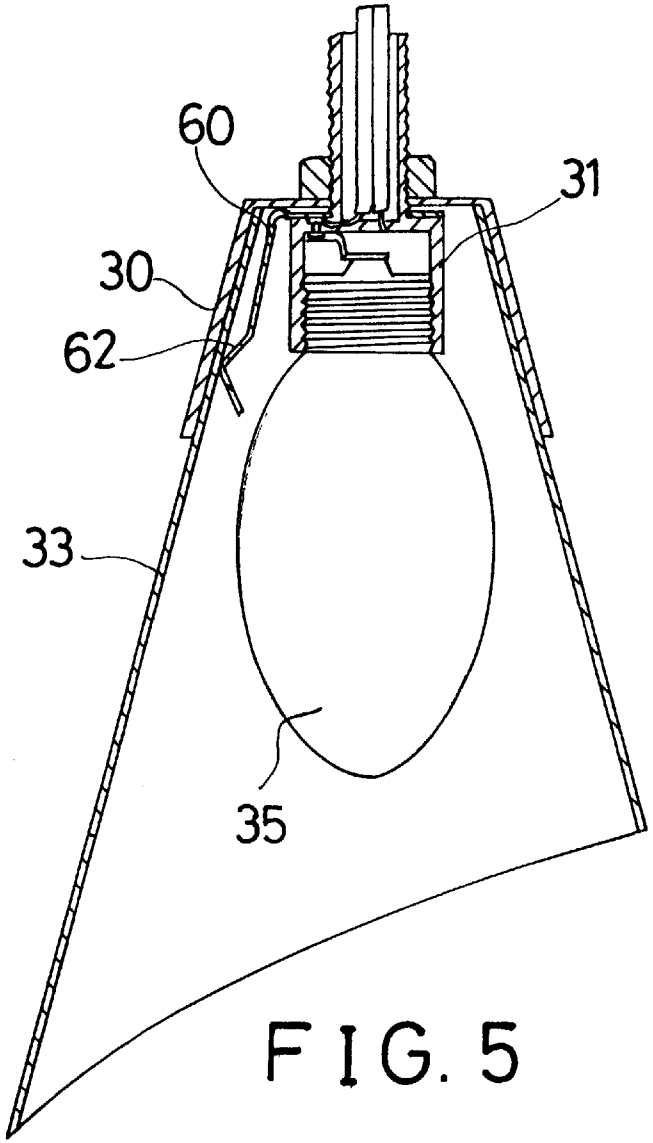
FIG. 5 is a cross sectional view of the lamp device as shown in FIG. 4.
Figure 4:
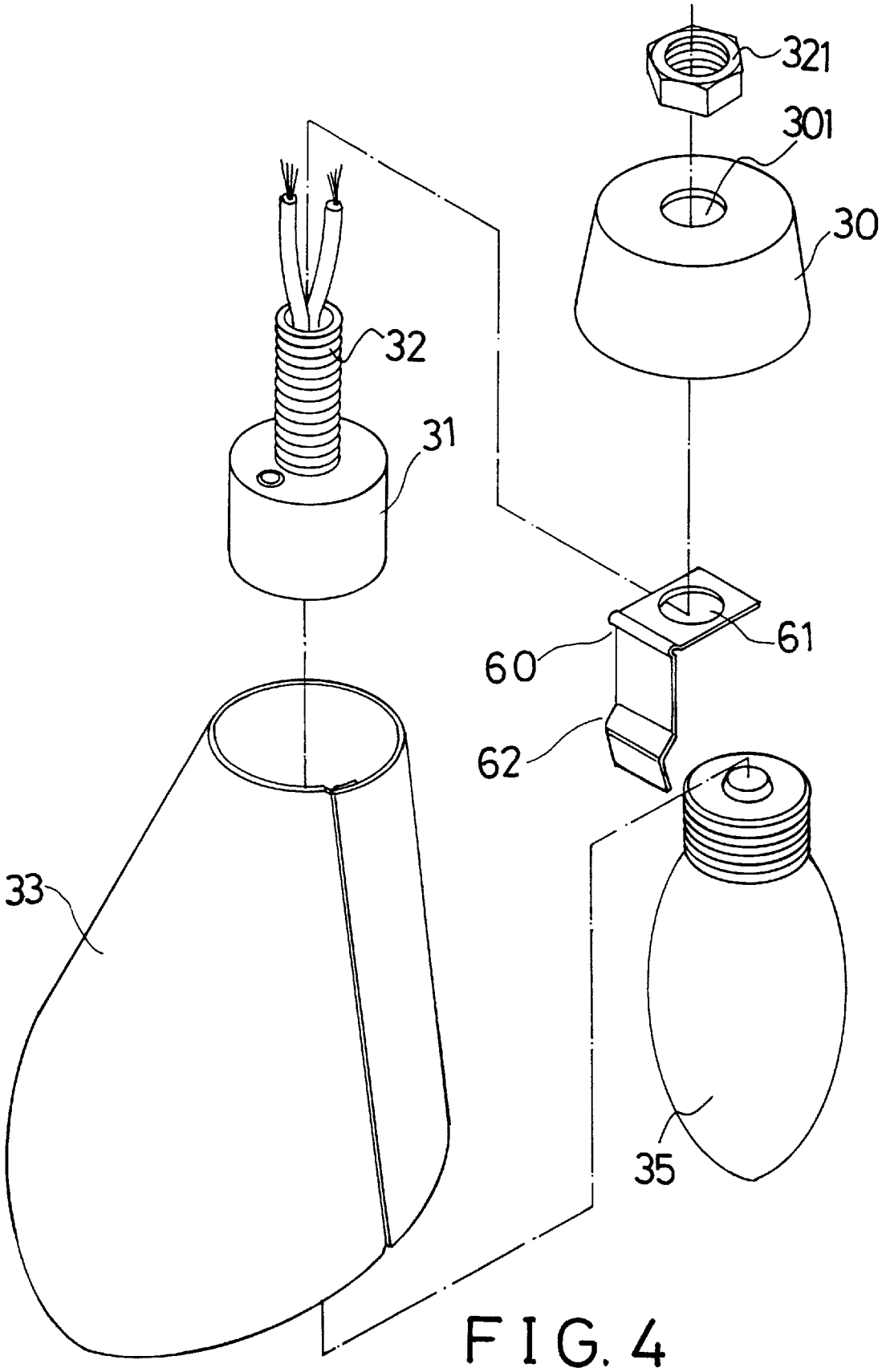
FIG. 4 is an exploded view showing another application of the lamp device.

Referring next to FIGS. 4 and 5, alternatively, the plate 60 includes an opening 61 for engaging with the bolt 32 and includes a spring leg 62 for engaging with and for securing the lamp shade 33 in place.

Accordingly, the lamp device in accordance with the present invention includes a lamp shade made of paper material and having light weight for allowing the lamp shade to be easily secured to the lamp housing without fasteners such as screws.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lamp device comprising:

a housing including a hole formed therein, a socket secured in said housing for securing a light bulb and including a bolt extended through said hole of said housing, a lamp shade including an upper portion secured in said housing, means for biasing against said upper portion of said lamp shade and for securing said lamp shade to said housing, said biasing means including a plate having an opening for engaging with said bolt and having a spring leg for biasing against said upper portion of said lamp shade, and said plate including at least one groove formed therein, said biasing means including a spring member having at least one extension secured in said at least one groove of said plate and having said spring leg for biasing against said upper portion of said lamp shade.

* * * * *